US006948833B2

(12) United States Patent
Wu

(10) Patent No.: US 6,948,833 B2
(45) Date of Patent: Sep. 27, 2005

(54) CEILING LAMP SUSPENDING DEVICE

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 308 days.

(21) Appl. No.: 10/452,864

(22) Filed: Jun. 3, 2003

(65) Prior Publication Data

US 2004/0246729 A1 Dec. 9, 2004

(51) Int. Cl.[7] ..... F21S 8/06
(52) U.S. Cl. ..... 362/406; 362/404; 416/5
(58) Field of Search ..... 362/406, 404; 348/342, 343; 416/5

(56) References Cited

U.S. PATENT DOCUMENTS 4,300,732 A * 11/1981 Gaeta ..... 242/379.2
6,565,240 B1 * 5/2003 Wu ..... 362/405
6,612,531 B2 * 9/2003 Wu ..... 248/317
6,655,816 B2 * 12/2003 Wu ..... 362/226
6,666,613 B2 * 12/2003 Wu ..... 403/299
6,695,464 B1 * 2/2004 Wu ..... 362/410
6,715,906 B1 * 4/2004 Wu ..... 362/405
6,733,159 B1 * 5/2004 Wu ..... 362/423
6,761,469 B2 * 7/2004 Wu ..... 362/226
6,793,378 B2 * 9/2004 Wu ..... 362/365

* cited by examiner

*Primary Examiner*—Stephen Husar
*Assistant Examiner*—Anabel Ton

(57) ABSTRACT

A ceiling lamp suspending device comprise the following elements. A wire connecting box has two ears arranged at two edges thereof. A retaining sheet is below the wire connection box. A through hole is near a center of the retaining sheet. One edge of the through hole is extended with and communicable to a long hole. A stop elastomer is disposed aside the through hole. A part of the stop elastmoer covering the through hole. A retaining block is installed below the retaining sheet. The retaining block has a threaded section and a shaft extended from the threaded section upwards. An upper end of the shaft is a neck portion and a suspending portion. A via hole is formed on the shaft. The suspending portion passes through the through hole of the retaining sheet; and the neck portion is movable in the long hole.

4 Claims, 6 Drawing Sheets

CEILING LAMP SUSPENDING DEVICE

BACKGROUND OF THE INVENTION

1. Field of the Invention

The present invention relates to lamp devices, and particularly to a ceiling lamp suspending device which can be assembled easily and has a longer lifetime.

2. Description of the Related Art

In the prior art, the wire connecting box of a lamp is locked to a retaining block. The center of the block has a hole. A threaded tube is locked to the retaining block. The threaded tube passes through a hole in the retaining block. Then the threaded tube is fixed by screwing with a male nut so that the retaining block will not fall down. A lower side of the retaining block is fixed with a hanging ring so that a lamp can be suspended from the ring. Thereby, the buckling block can load the lamp.

However, above prior art has the following defect. Firstly, the prior art retaining block is made of iron which is cheap, but weak. It is often that after it is used for a time period, the retaining block cracks and thus is dangerous. Moreover, in assembly, the lamp is heavy and much labor is necessary in assembly. Thus the cost is high and the operation is inconvenient.

SUMMARY OF THE INVENTION

Accordingly, the primary object of the present invention is to provide a lamp hanging structure which can be installed easily and has a longer lifetime.

To achieve above objects, the present invention provides a ceiling lamp suspending device comprise the following elements. A wire connecting box has two ears arranged at two edges of the wire connection box. A retaining sheet is below the wire connection box. A center of the retaining sheet has a through hole. One edge of the through hole is extended with and communicable to a long hole. A stop elastomer is disposed aside the through hole. A part of the stop elastmoer covering the through hole. A retaining block is installed below the retaining sheet. The retaining block has a threaded section and a shaft extended from the threaded section upwards; an upper end of the shaft being a neck portion and a suspending portion. A via hole is formed on the shaft. The suspending portion passes through the through hole of the retaining sheet; and the neck portion is movable in the long hole.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
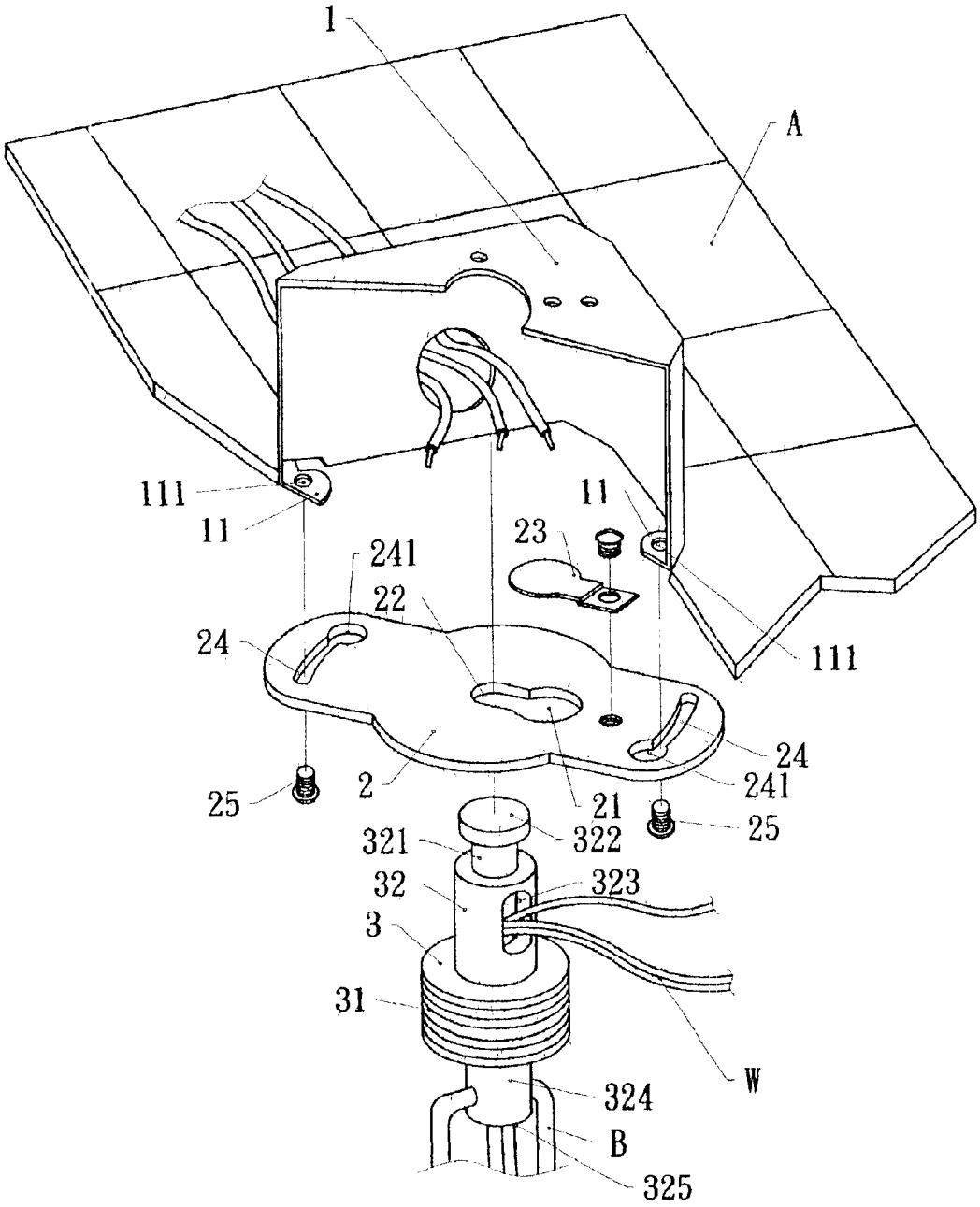
FIG. 1 is an exploded perspective view of the wire connecting box of the present invention.

Referring to FIG. 1, a wire connecting box 1 is embedded into and fixed to the ceiling A. An edge of the wire connecting box 1 has two ears 11 which are symmetrically arranged. Each ear 11 has a positioning hole 111. A retaining sheet 2 is at the lower side. A center of the retaining sheet 2 has a through hole 21. One edge of the through hole 21 is extended with and communicable to a long hole 22. A stop elastomer 23 is disposed aside the through hole 21. A part of the stop elastmoer 23 covers the through hole 21. Each of two sides of the retaining sheet 2 is formed with a respective retaining hole 24 at a position corresponding to the positioning hole 111. A retaining block 3 is installed below the retaining sheet 2. The retaining block 3 has a threaded section 31 and a shaft 32 extended from the threaded section 31 upwards. An upper end of the shaft 32 is a neck portion 321 and a suspending portion 322 is extended from the neck portion 321. A via hole 323 is formed on the shaft 32. A post 324 extends from the threaded section 31 downwards for suspending a chain B. A longitudinal center of the post 324 has a channel (not shown), and the channel is communicable to the via hole 323 so that electric wires W can pass through the channel to the via hole 323.

The suspending portion 322 of the shaft 32 has an outer diameter slightly smaller than the hole diameter of the through hole 21 of the retaining sheet 2. Furthermore, the neck portion 321 of the shaft 32 has an outer diameter D slightly smaller than a width of the long hole 22 of the retaining sheet 2. The outer diameter of the suspending portion 322 is larger than the width of the long hole 22.

Figure 2:
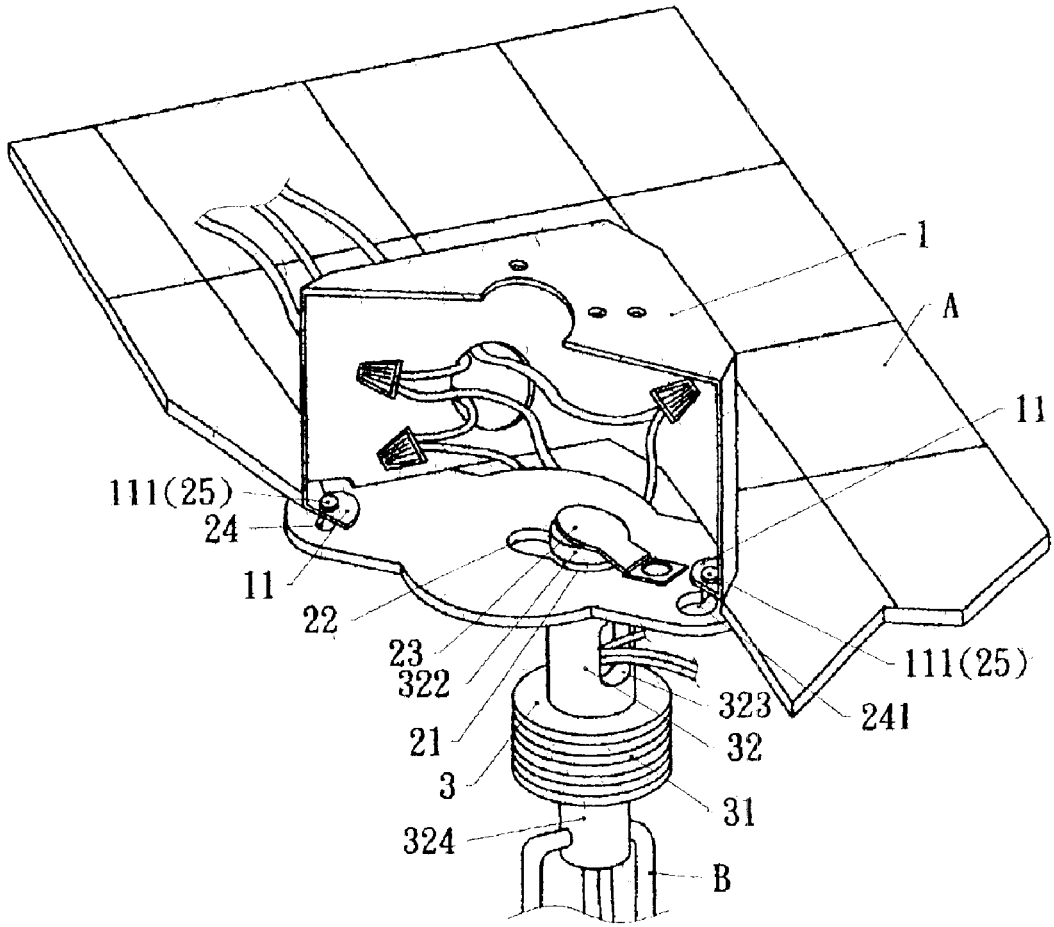
FIG. 2 is a perspective view of the present invention showing the assembly and installation of the present invention.
Figure 3:
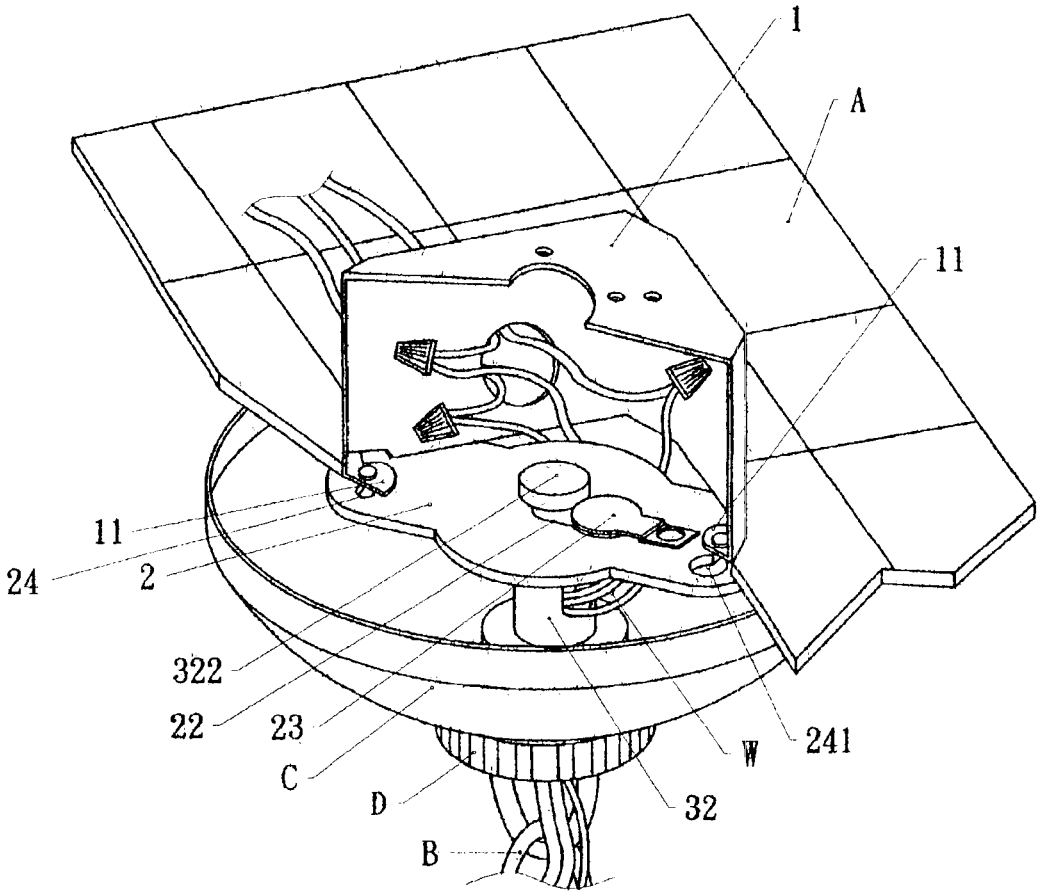
FIG. 3 shows the assembled view of the present invention.

Therefore, by above mentioned structure, referring to FIG. 2, when the retaining sheet 2 is locked to the positioning holes 111 of the ears 11 of the wire connection box 1, the suspending portion 322 of the shaft 32 inserts into the through holes 21 of the retaining sheet 2. Further, the stop elastomer 23 ejects upwards so that the neck portion 321 of the shaft 32 is exactly positioned in the through hole 21. With reference to FIG. 3, the shaft 32 can be pushed toward the long hole 22 of the retaining sheet 2 so that the neck portion 321 is positioned to the long hole 22. The suspending portion 322 is supported by the long hole 22 aand thus the shaft 32 will not fall down. Moreover, the stop elastomer 23 restores to the position of the neck portion 321 to prevent the movement of the shaft 32. Thus, the shaft 32 is positioned to the long hole 22 of the retaining sheet 2.

Figure 4:
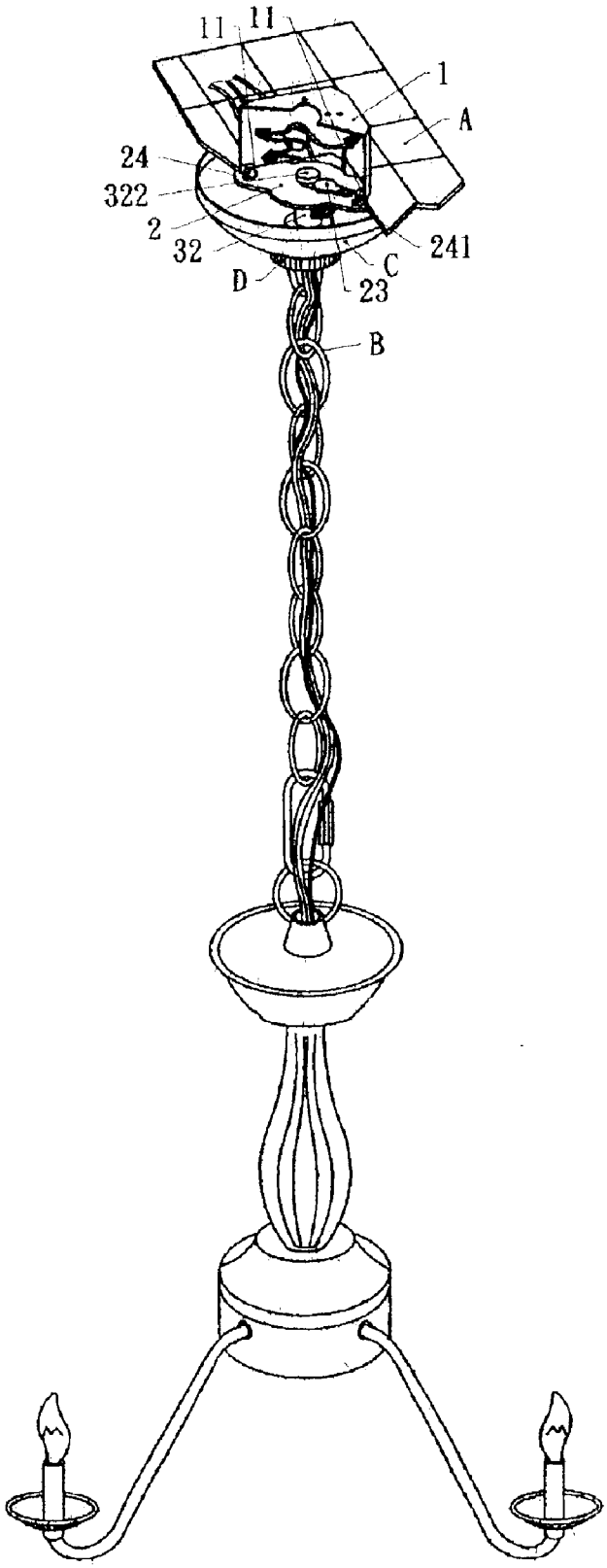
FIG. 4 shows one embodiment of the present invention.

Referring to FIGS. 3 and 4, to beautify the appearance of the wire connection box 1, a cover C serves to cover the wire connection box 1. A retaining ring D is locked o the threaded section 31 of the retaining block 3. Then the cover C tightly resists against the ceiling A for shielding the wire connection box 1 so as to present a beautiful outlook.

With reference to FIGS. 1 and 2 again, the retaining hole 24 of the retaining sheet 2 has a cambered shape and one edge of the retaining hole 24 is formed with a penetrating hole 241. A diameter of the penetrating hole 241 is slightly larger than an outer diameter of a screw head. An outer diameter of the screw is larger than a width of the cambered retaining hole 24. Therefore, before locking the retaining sheet 2 to the wire connection box 1, a screw can be locked to the positioning hole 111 of the ear 11 temporarily, but not tightly engaged thereto so that a proper distance is retained between the screw and the ear 11. Then the screw 25 can pass through the via hole 241 of the retaining sheet 2 and then the retaining sheet 2 is twisted so that the screw 25 is positioned at the cambered retaining hole 24. Then the retaining sheet 2 is tightly engaged to the ear 11 by the screw 11. Thus, the installation operation is easy and convenient.

Figure 5:
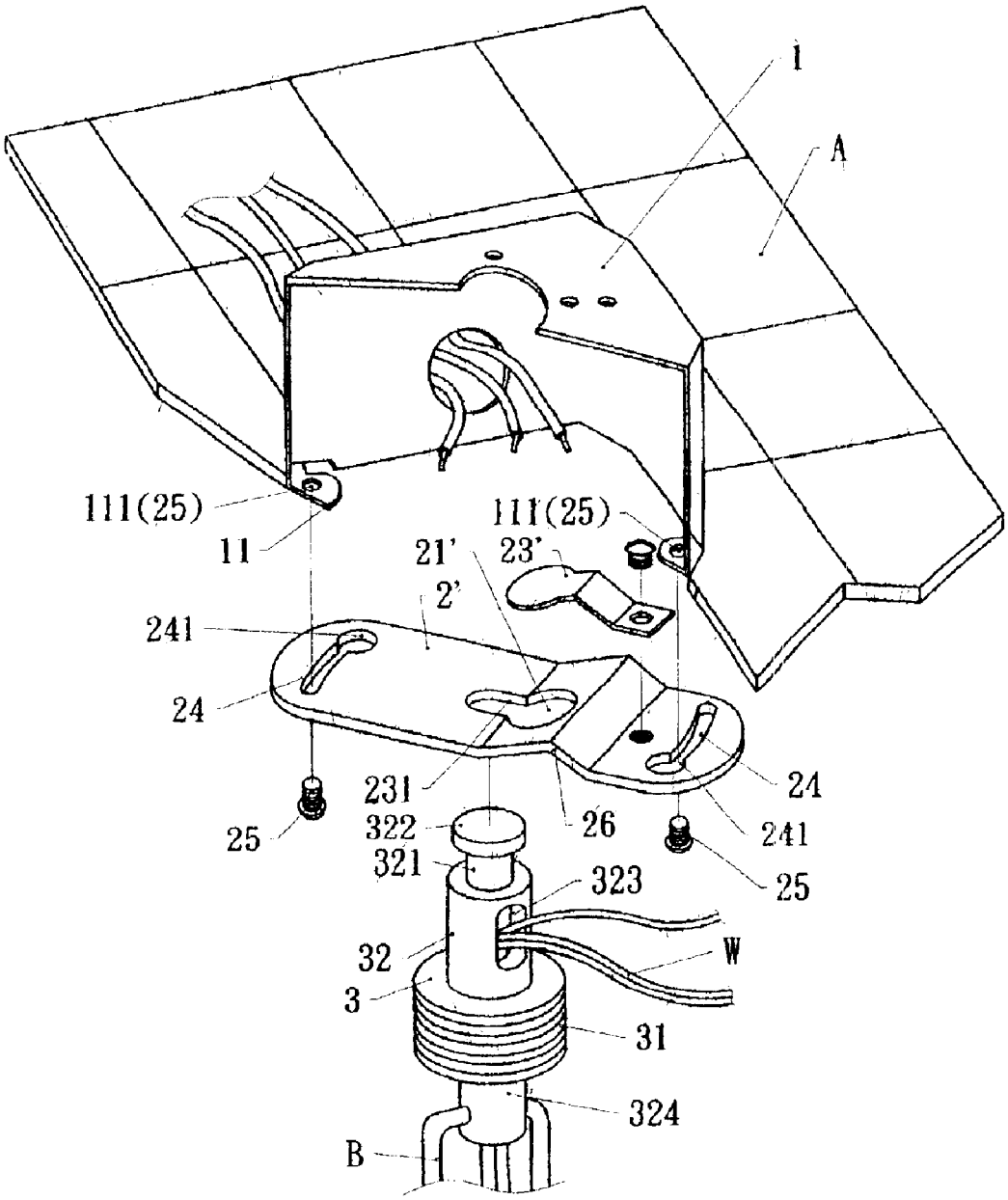
FIG. 5 shows another embodiment of the present invention.
Figure 6:
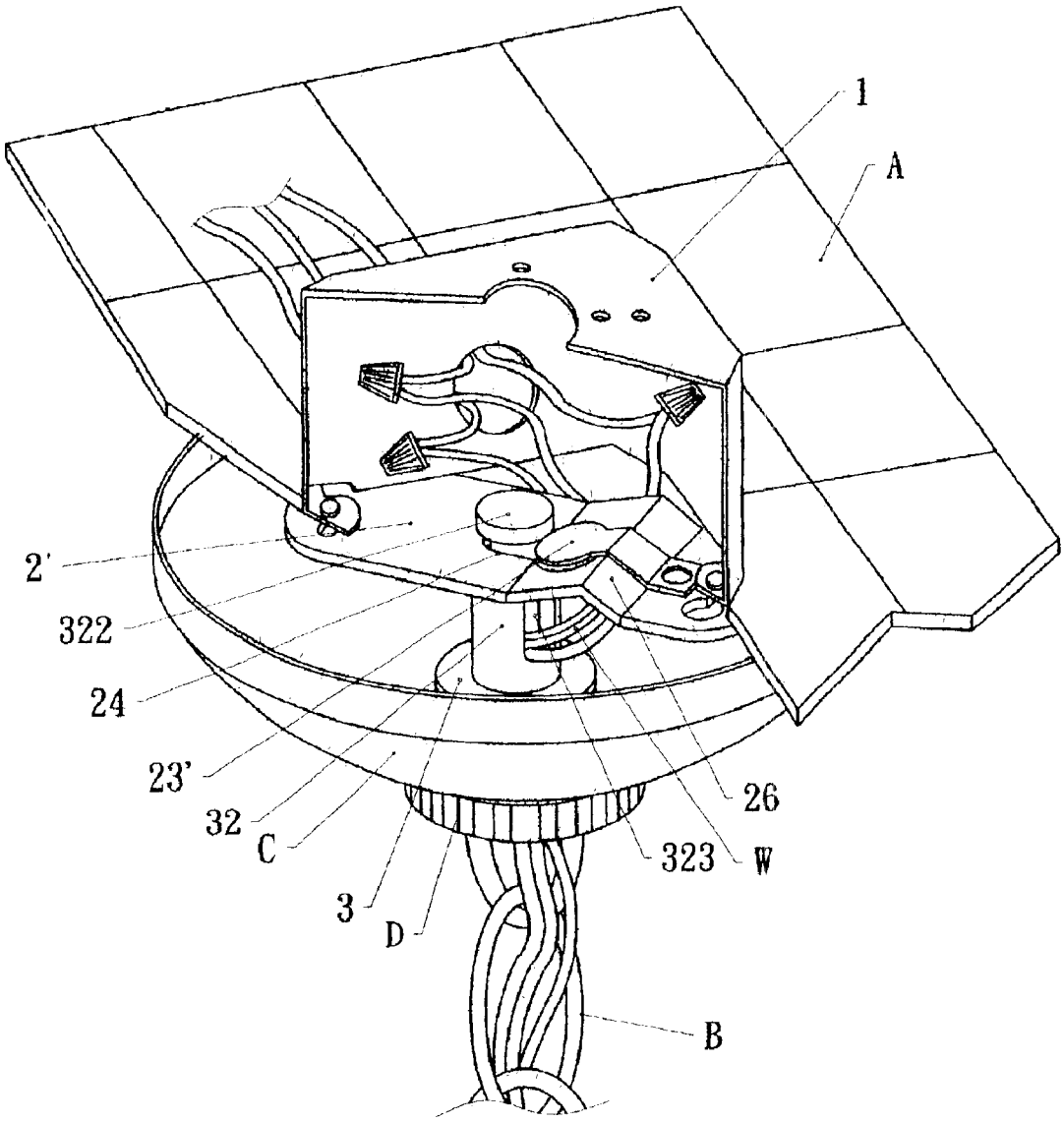
FIG. 6 shows the assembly view of another embodiment of the present invention.

With reference to FIG. 5, another embodiment of the present invention is shown. The retaining sheet 2' is formed with a wedge-form enhancing rib 26 with one side of the wedge having a part of this through hole 21'. The stop elastomer 23' has a configuration matching to the rib 26. As shown in FIG. 6, the stop elastomer 23' is tightly adhered on and cover the rib 26. Thus the suspending portion 322 of the shaft 32 can be inserted into the through hole 21' opaquely to have the same installation function. The rib 26 has the function of enhancing the support a lamp. Thus, the neck portion 321 is opaquely inserted into the long hole 22. When the stop elastomer 23 is resilient, it can resist against the neck portion 321.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A ceiling lamp suspending device comprising:

a wire connecting box having two ears which are symmetrically arranged at two edges of the wire connection box;

a retaining sheet below the wire connection box; the retaining sheet having a through hole near a center of the retaining sheet; one edge of the through hole being extended with and communicable to a long hole;

a stop elastomer disposed aside the through hole; a part of the stop elastmoer covering the through hole;

a retaining block install below the retaining sheet; the retaining block having a threaded section and a shaft extended from the threaded section upwards; an upper end of the shaft being a neck portion and a suspending portion being extended from the neck portion; a via hole being formed on the shaft; the suspending portion passing through the through hole of the retaining sheet; and the neck portion being movable in the long hole of the retaining sheet so that the suspending portion is supported in the long hole;

wherein when the retaining sheet is locked to the positioning holes of the ears of the wire connection box, the suspending portion of the shaft inserts into the through holes of the retaining sheet; the stop elastomer ejects upwards so that the neck portion of the shaft is positioned in the through hole; the shaft is pushed toward the long hole of the retaining sheet so that the neck portion is positioned in the long hole; the suspending portion is supported by the long hole and thus the shaft will not fall down; moreover, the stop elastomer restores to the position of the neck portion to prevent the movement of the shaft; thus, the shaft is positioned to the long hole of the retaining sheet.

2. The ceiling lamp suspending device as claimed in claim 1, wherein the suspending portion of the shaft has an outer diameter slightly smaller than a hole diameter of the through hole of the retaining sheet; the neck portion of the shaft has an outer diameter slightly smaller than a width of the long hole of the retaining sheet; and the outer diameter of the suspending portion is larger than the width of the long hole.

3. The ceiling lamp suspending device as claimed in claim 1, wherein the retaining hole of the retaining sheet has a cambered shape and one edge of the retaining hole is formed with a penetrating hole; a diameter of the penetrating hole is slightly larger than an outer diameter of a screw head; and an outer diameter of the screw is larger than a width of the cambered retaining hole.

4. The ceiling lamp suspending device as claimed in claim 1, wherein the retaining sheet is formed with a wedge shape enhancing rib with one side of the wedge having a part of the through hole; the stop elastomer has a configuration matching to the rib; the stop elastomer is tightly adhered on and cover the rib; the suspending portion of the shaft is inserted into the through hole opaquely so as to have the same installation function; the neck portion is opaquely inserted into the long hole; when the stop elastomer is resilient, it can resist against the neck portion.

* * * * *